United States Patent [19]

Robideau

[11] Patent Number: 4,697,480

[45] Date of Patent: Oct. 6, 1987

[54] RADIATOR CAP SAFETY TWIST-OFF TOOL

[76] Inventor: Terry Robideau, 1426 S. Bentley Ave., Los Angeles, Calif. 90025

[21] Appl. No.: 912,598

[22] Filed: Sep. 29, 1986

[51] Int. Cl.[4] ..... B67B 7/44

[52] U.S. Cl. ..... 81/3.09; 81/3.4; 7/100

[58] Field of Search ..... 81/3.4, 176.1, 176.2, 81/3.07, 3.09; 7/100, 138

[56] References Cited

U.S. PATENT DOCUMENTS

| | | | |
|---|---|---|---|
| 3,007,357 | 11/1961 | Nalley | 81/176.1 |
| 3,014,389 | 12/1961 | O'Hara | 81/176.2 |
| 3,048,067 | 8/1962 | Miles et al. | 81/176.1 |
| 3,121,355 | 2/1964 | Morel et al. | 81/3.4 |
| 3,186,263 | 6/1965 | Grote | 81/176.1 |
| 3,262,247 | 7/1966 | Scholle | 81/3.4 |
| 3,371,563 | 3/1968 | Lallo | 81/176.2 |
| 3,638,515 | 2/1972 | Lentz | 81/176.2 |

*Primary Examiner*—Roscoe V. Parker

*Attorney, Agent, or Firm*—Beehler, Pavitt, Siegemund, Jagger, Martella & Dawes

[57] ABSTRACT

A tool useful in facilitating the safe twist-off of an automotive radiator cap. The novel tool comprises a wrench element having an elongated handle with a radiator cap receiving socket at the lower end of the handle, and a shield element having a tubular grip with a hood skirt affixed at the lower end of the grip tube. The shield element is open at both its ends and the elongated wrench handle is both rotatable and axially slideable within the shield grip. In an operative assembled condition of the tool the wrench element is axially inserted into the shield element so as to shroud the cap wrench socket within the hood for deflecting hot liquid or stem ejected from a radiator, the hot fluid being diverted by the hood away from the person operating the tool.

20 Claims, 6 Drawing Figures

RADIATOR CAP SAFETY TWIST-OFF TOOL

BACKGROUND OF THE INVENTION

1. Field of the Invention

The present invention pertains generally to the field of automotive hand tools and is more particularly directed to a radiator cap twist-off tool adapted to shield the user against injury from being splattered by hot coolant fluids.

2. State of the Prior Art

The great majority of private and commercial road vehicles powered by internal combustion engines are equipped with engine cooling systems using liquid coolant. Such cooling systems typically feature a radiator unit which serves as an air/liquid heat exchanger whereby the hot coolant dissipates engine heat to the atmosphere.

On occasion, it becomes necessary to open the radiator so as to add coolant. This is particularly likely to occur in older vehicles which lack modern sealed cooling systems with coolant recovery containers, and is further most likely to occur when the vehicle overheats as during extended highway travel or uphill driving in hot weather. Under such circumstances coolant liquid may be lost from the system and if not replenished the engine must be shut down and travel must cease. Frequently, by the time the vehicle operator realizes that coolant must be added to the system the radiator temperature and pressure has risen beyond levels at which it is safe to manually open the radiator cap, thus forcing and extended wait for the system to cool down.

Prior art devices exist for facilitating the removing radiator caps as disclosed U.S. Pat. Nos. 3,186,263 to Grote, 3,048,067 to Miles et al, 3,121,355 to Morel et al, and 3,007,357 to Nalley. These devices may function well in facilitating the mechanical removal of the radiator caps, but none are fully satisfactory from a safety aspect. This applicant is not aware of any existing tools or devices particularly adapted for protecting the user in opening an automotive radiator cap while a risk still exist of hot coolant being ejected from the radiator fill opening. A continuing need therefore exists for a safe, simple to operate, low cost tool which will permit the opening and removal of radiator caps with minimal fear of injury from hot liquid ejected under pressure from the radiator.

SUMMARY OF THE INVENTION

The present invention seeks to meet the aforementioned need by providing a tool useful in facilitating the safe twist-off of an automotive radiator cap. The novel tool comprises a wrench element having an elongated handle with a radiator cap receiving socket at the lower end of the handle, and a shield element having a tubular grip with a hood skirt affixed at the lower end of the grip tube. The shield element is open at both its ends and the elongated wrench handle is both rotatable and axially slideable within the shield grip. In an operative assembled condition of the tool the wrench element is axially inserted into the shield element so as to shroud the cap wrench socket within the hood for deflecting hot liquid or stem ejected from a radiator, the hot fluid being diverted by the hood away from the person operating the tool.

The wrench handle is longer than the shield grip tube such that when the two elements are assembled into cooperative relationship, the upper end of the wrench handle protrudes from the upper end of the shield grip while the wrench socket is shrouded within the shield, so that the wrench element can be turned with one hand while the wrench is fitted onto a radiator cap, and at the same time the shield element is held stationary and firmly against the top of the radiator surrounding the radiator cap with the other hand. The neck of the radiator fill opening thus extends into the space shrouded by the shield and any liquid or steam ejected from the radiator opening will be contained by the shield wall.

The cap wrench socket of the wrench element is preferably provided with a coupling element arranged within the socket cavity for transmitting torque from the wrench element to a radiator cap element, either by fricitonal engagement with the radiator cap or by deforming to conform to the shape of the cap or by a combination of the two, without other mechanical interlock between the wrench element and the radiator cap. This feature is useful in current model radiator caps which are circular and are not equipped with radially projecting twist-off lugs as was commonly the case with radiator caps in older model vehicles. However, to also accomodate such older radiator caps, the wrench socket at least two diametrically opposite notches are formed in the annular wall defining the socket cavity for receiving and interlocking with radiator cap twist-off lugs.

The device may further include a retaining end cap removably engageable to the end of the wrench handle opposite the shield so as to allow limited sliding of the shield along the wrench handle but prevent withdrawal of the wrench element from the shield element. It is desirable for the end cap to be readily removable so as to allow separation of the wrench element from the shield element. The separate shield element can then be used as a funnel for filling the radiator or otherwise pouring liquids.

DETAILED DESCRIPTION OF THE PREFERRED EMBODIMENT

Figure 1:
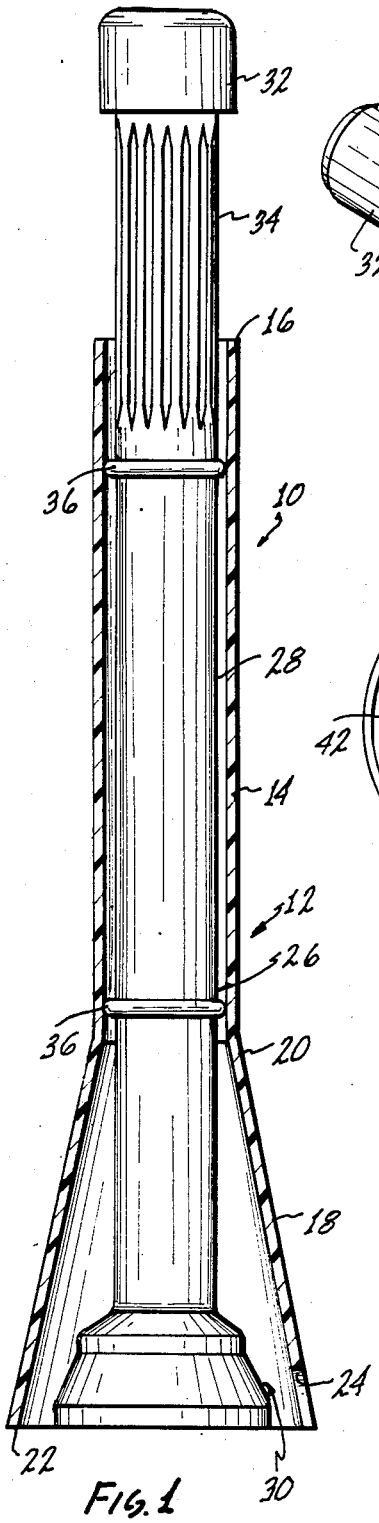
FIG. 1 is an elevational view of the assembled tool showing the shield element in longitudinal section to expose the wrench element.

With reference to the drawings, the novel tool of this invention may be seen in FIG. 1 as comprising an outer shield element 12 having a cylindrical tubular grip 14 with an open upper end 16 and a conical hood skirt 18 flaring from a lower end 20. The lower end 22 of the hood 18 is open with a notch 24 defined in the lower rim of the hood, best seen in FIGS. 2 and 3.

A wrench element 26 has an elongated cylindrical handle 28 and a wrench socket 30 affixed at its lower end. The wrench handle 28 is slideable within the tubular grip 14 of the shield element 12, and the wrench element 26 can therefore be both rotated within the shield element 12 as well as axially displaced relative thereto such that the wrench socket 30 can be slid downwardly from the interior of the conical shield 18 to an exposed position seen in FIG. 4*a*. The downward axial displacement of the wrench element relative to the shield element is limited by a removable end cap 32 retained by friction fit to the upper end of the wrench element handle 28. The uppermost portion of the wrench handle 28 is scored in a longitudinal direction so as to provide a high friction grip surface 34.

Two axially spaced apart ring seal elements 36, which in this embodiment are formed integrally with the tubular wrench handle 28, make sliding contact with the cylindrical inner surface of the grip tube 14 so as to substantially seal the tube 14 against passage of liquid or steam upwardly from the hood into the space between the tube 14 and wrench handle 28, thus to protect the person using the tool against exposure to heated fluids, particularly against injury to the hand gripping the upper end of the wrench handle 28. The two annular bearing surfaces 36 minimize the surface contact between the wrench handle 28 and shield grip 14 and consequently also minimize the friction therebetween during relative rotation of the two elements, yet maintaining the aforementioned liquid and steam-tight seal. The diameter of the handle 28 is therefore somewhat smaller than the inner diameter of the shield grip 14, while the two seal elements 36 make a snug sliding fit with the inside diameter of the shield grip tube 14.

The axial length of the wrench handle 28 is greater than the axial length of the grip tube by an amount sufficient to leave exposed an upper section of the wrench handle 28 while the bottom of the wrench socket 30 is generally aligned with lower end 22 of the hood 18, as illustrated in FIG. 1. The exposed upper portion of the wrench handle 28 should be sufficiently long to allow comfortable and positive gripping thereof with one hand by the tool operator while with the other hand the tool operator grips the tube 14 of the shield element 12.

Figure 3:
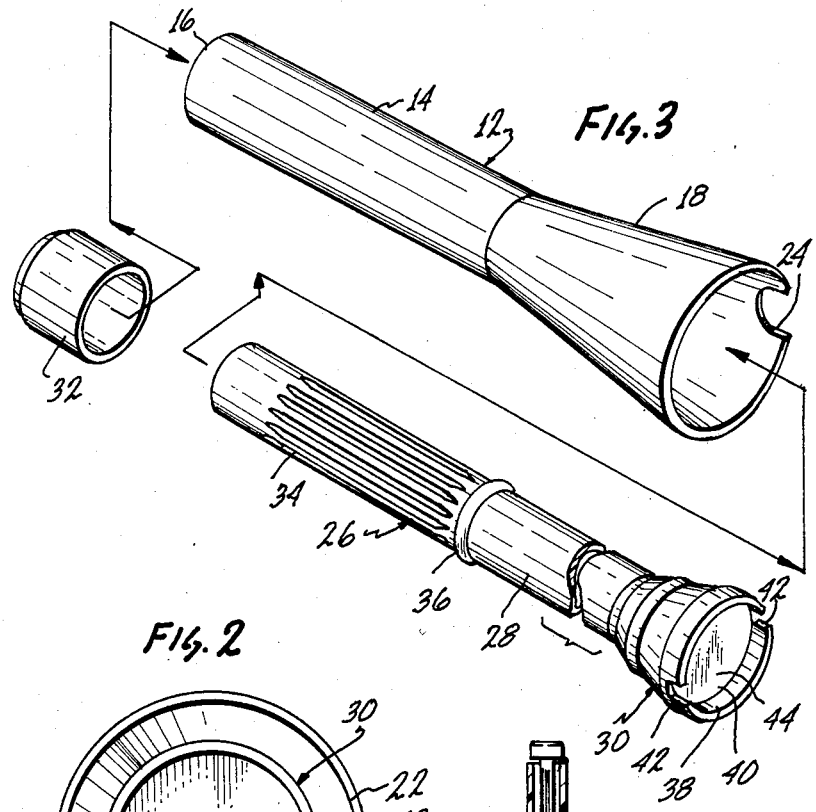
FIG. 3 is a perspective view showing the three elements of the tool of FIG. 1 in axially exploded relationship.
Figure 2:
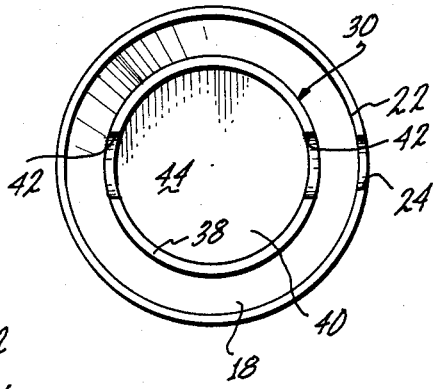
FIG. 2 is a bottom end view of the assembled tool of FIG. 1.

The wrench socket 30 is best seen in FIGS. 2 and 3, and includes an annular wall 38 encompassing a socket cavity 40. The annular wall 38 is cut to define two diametrically opposed notches 42 dimensioned to receive twist-off lugs provided on certain radiator caps, particularly in older vehicles.

Radiator caps devoid of twist-off lugs are frictionally engaged by means of a circular disk 44 of soft, resilient rubber, preferably an ultrasoft Neoprene resistant to heat, e.g. up to 200 degrees F., oil and water. The circular sheet 44 of neoprene material is affixed to the circular bottom of the wrench socket 30 and present a high friction surface engageable with the top of a radiator cap for frictional coupling of the wrench element 26 to a radiator cap having no twist-off lugs by applying moderate downward force on the wrench handle 28. The soft rubber material under pressure closely conforms to the shape of the radiator cap to further aid in the positive transmission of torque from the wrench element 26 to the cap.

Figure 4A:
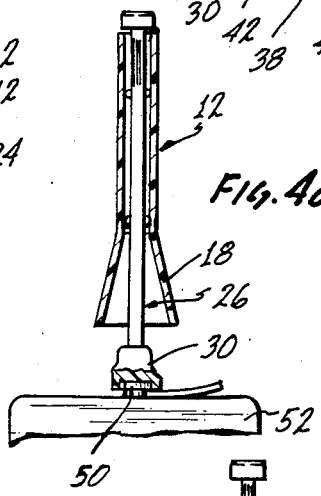
FIG. 4*a* shows the wrench socket of the novel tool being fitted onto a radiator cap.
Figure 4B:
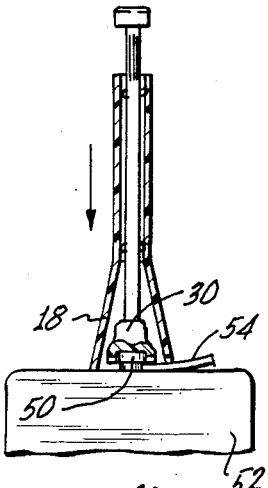
FIG. 4*b* shows the shield element being lowered against the radiator top prior to cap twist-off.
Figure 4C:
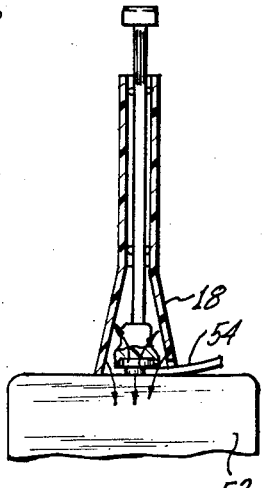
FIG. 4*c* illustrates the radiator cap being twisted off the radiator and fluid ejected therefrom being deflected by the shield portion of the tool.

The manner of operation of the novel tool will be now described with reference to the sequence illustrated in FIGS. 4*a*–4*c*. In a first step shown in FIG. 4*a*, the wrench element 26 is axially displaced downwardly relative to the shield element 12, exposing the cap socket 30 outwardly of the hood 18 so as to permit visualization of the engagement between the cap socket 30 and a radiator cap 50 in a typical radiator 52. Once the radiator cap 50 is securely received within the socket cavity 40, the shield element 12 is slid axially downwardly along the wrench handle 28 until the lower edge 22 of the hood 18 seats against the top of the radiator 52. In the frequent case where the radiator 52 is provided with an overflow tube 54 extending from the neck of the radiator fill tube, the overflow tube 54 is received within the notch 24 provided for this purpose in the hood skirt 18, allowing positive seating of the hood 18 against the radiator top as shown in FIG. 4*b*.

The wrench element 26 is then rotated to impart twisting movement to the radiator cap 50 while the shield element 12 is held stationary and firmly against the top of radiator 52. As the radiator cap seal is broken, if residual pressure remains in the cooling system, hot liquid may spurt from the radiator 52 in the manner generally indicated by the arrows in FIG. 4*c*. The hot liquid however is ejected within the interior confines of the conical hood 18 and is contained by the hood wall thus protecting the tool operator against contact with the hot fluid. Any liquid ejected from the radiator will strike the interior wall surface of the hood 18 and thence flow down onto the top of radiator 52 and into the engine compartment or onto the ground in a harmless manner.

The three elements 12, 26 and 32 comprising the novel tool may be molded of any suitable plastic material selected for sufficient resistance to heat, oils and other fluids or chemicals likely to be encountered in the automotive environment.

A further advantage of the present invention is the availability of the shield element 12 for use as a pouring funnel. For such use the tool 10 is disassembled by removing the retaining cap 32 from the end of wrench handle 28, then axially extracting the wrench element 26 from the lower hood end of the shield element 12, and then inverting the shield element 12 such that the wide end of the hood 18 is oriented upwardly for receiving liquid which is discharged through the grip tube 14 and through its narrower end 16 into any desired receptacle. In particular, the use of the shield element 12 as a funnel will be found useful in refilling a radiator with coolant liquid.

While a particular embodiment of the invention has been shown and illustrated for purposes of clarity and explanation, many changes, substitutions and modifications to the described embodiment will become apparent to those possessed of ordinary skill in the art without departing from the spirit and scope of the present invention which is defined only by the following claims.

What is claimed is:

1. A tool for facilitating safe twist-off of an automotive radiator cap comprising:

a wrench element having an elongated handle and a radiator cap receiving socket at one end of said handle; and a shield element having a tubular grip and a hood affixed to one end of said tubular grip;

said elongated handle being rotatable within said tubular grip and also slidably movable between a first position wherein said socket remains exposed below said hood for facilitating engagement of the socket to a radiator cap and a second position wherein said socket is retracted within and radially shrouded by said hood for deflecting hot liquid ejected from a radiator upon removal of a radiator cap which is thus safely diverted by the hood away from the tool user.

2. The tool of claim 1 wherein said grip has an open upper end and said handle extends from said upper end when said socket is shrouded by said hood such that said wrench element can be turned with one hand to twist off a radiator cap while said shield element is held stationary over the cap and against the top of a radiator.

3. The tool of claim 2 further comprising an end cap removably engageable on the other end of said elongated handle for preventing withdrawal of said wrench element from said shield element.

4. The tool of claim 1 wherein said shield element is separable from said wrench element for use as a funnel for facilitating the pouring of liquids.

5. The tool of claim 1 further comprising deformable coupling means arranged in said socket for transmitting torque from said wrench element to a radiator cap received in said socket.

6. The tool of claim 1 further comprising friction coupling means arranged in said socket for transmitting torque from said wrench element to a radiator cap received in said socket.

7. The tool of claim 6 wherein said friction coupling means comprises a disc of material presenting a relatively high friction surface disposed for engaging the top of a radiator cap received in said socket.

8. The tool of claim 7 wherein said friction coupling means is a sheet of rubber.

9. The tool of claim 1 wherein said socket includes diametrically opposed notches for receiving radiator cap twist-off lugs.

10. The tool of claim 1 wherein said hood is generally conical.

11. The tool of claim 8 wherein both said grip and said handle are substantially cylindrical.

12. The tool of claim 1 further comprising interior seal means between said tubular grip and said handle for preventing flow of liquid through said grip between said two elements.

13. A tool for facilitating safe opening of an automotive radiator cap comprising:

a wrench element having an elongated handle and a radiator cap receiving socket at one end of said handle;

a shield element having a tubular grip with an open upper end and a generally conical hood affixed to the lower end of said tubular grip together defining a funnel structure useable for facilitating the pouring of liquids into relatively small openings;

said elongated handle being rotatably removably receivable within said tubular grip with said handle extending from said upper end while said socket is shrouded by said hood such that said wrench element can be turned with one hand to twist-off a radiator cap while said shield element is held stationary with another hand over the radiator cap and against the top of a radiator for deflecting hot liquid ejected from the radiator away from the person holding the tool upon removal of the radiator cap; and retaining means for limiting axial sliding movement of said shield element along said wrench handle to thereby normally prevent separation of the shield and wrench elements but allowing limited slidable displacement of said wrench element within said shield element between a first position wherein said socket is exposed below said lower end of the hood for facilitating engagement of the socket to a radiator cap and a second position wherein said socket is retracted within and radially shrouded by said hood, said retaining means being manually releasable for allowing separation of said wrench and said shield elements thereby to allow the shield to be used as a funnel.

14. The tool of claim 13 wherein said retaining means comprise and end cap removably engageable to the upper end of said elongated handle for preventing withdrawal of said wrench element from said shield element.

15. The tool of claim 13 further comprising friction coupling means arranged in said socket for transmitting torque from said wrench element to a radiator cap received in said socket.

16. The tool of claim 15 wherein said friction coupling means comprises a disc of material presenting a relatively high friction surface disposed for bearing against the top of a cap received in said socket.

17. The tool of claim 13 wherein said socket includes diametrically opposed notches in a socket wall for receiving and interlocking with radiator cap twist-off lugs.

18. A tool for facilitating safe twist-off of an automotive radiator cap comprising:

a wrench element having an elongated cylindrical handle and a socket at a lower end of said handle, said socket defining a socket cavity including a socket bottom for receiving a radiator cap, and a sheet of soft resilient material affixed to said socket bottom in said socket cavity for frictionally transmitting torque from said wrench element to a radiator cap received in said socket cavity; and a shield element having a tubular cylindrical grip axially shorter than said handle and having an inner diameter slightly greater than the outside diameter of said handle for axially slidably receiving said handle, said grip flaring at one end into a conical hood terminating in an open lower end, said shield element thus forming a funnel structure useable for pouring of liquids into relatively small openings;

said elongated handle being rotatably receivable within said tubular grip with the upper end of said handle extending therefrom while said socket is shrouded by said hood such that said wrench element can be turned with one hand to twist off a radiator cap while said shield element is held stationary with another hand over the radiator cap and against the top of a radiator for deflecting hot liquid ejected from the radiator away from the person holding the tool upon removal of the radiator cap; and an end cap removably engageable to the upper end of said elongated handle for normally stopping withdrawal of said wrench element from said shield element but allowing limited slidable displacement of said wrench element within said shield element between a first position wherein said socket is exposed below said lower end of the hood for facilitating engagement of the socket to a radiator cap and a second position wherein said socket is retracted within and radially shrouded by said hood, said cap being removable from said handle for allowing separation of said wrench and said shield elements thereby to allow the shield to be used as a funnel.

19. The tool of claim 18 wherein said friction coupling means comprises a disc of Neoprene rubber material affixed to a bottom surface of said socket cavity for presenting a relatively high friction surface against the top of a radiator cap received in said socket cavity.

20. The tool of claim 18 wherein said socket includes diametrically opposed notches for receiving radiator cap twist-off lugs.

* * * * *